US010429057B1

(12) United States Patent
Templer

(10) Patent No.: US 10,429,057 B1
(45) Date of Patent: Oct. 1, 2019

(54) LIGHT-UP BEARD

(71) Applicant: ELEGANT HEADWEAR CO., INC., Elizabeth, NJ (US)

(72) Inventor: Joseph Templer, Spring Valley, NY (US)

(73) Assignee: Elegant Headwear Co., Inc., Elizabeth, NJ (US)

( * ) Notice: Subject to any disclaimer, the term of this patent is extended or adjusted under 35 U.S.C. 154(b) by 58 days.

(21) Appl. No.: 15/490,260

(22) Filed: Apr. 18, 2017

Related U.S. Application Data

(60) Provisional application No. 62/323,862, filed on Apr. 18, 2016.

(51) Int. Cl.

| | |
|---|---|
| ***F21V 21/08*** | (2006.01) |
| ***F21V 33/00*** | (2006.01) |
| ***A41D 27/08*** | (2006.01) |
| ***A41D 27/20*** | (2006.01) |
| ***A41G 5/00*** | (2006.01) |
| ***F21V 23/00*** | (2015.01) |
| *F21Y 115/10* | (2016.01) |
| *F21Y 113/13* | (2016.01) |
| *F21W 121/06* | (2006.01) |

(52) U.S. Cl.
CPC ..... *F21V 33/0008* (2013.01); *A41D 27/085* (2013.01); *A41D 27/205* (2013.01); *A41G 5/004* (2013.01); *F21V 21/0832* (2013.01); *F21V 23/002* (2013.01); *F21W 2121/06* (2013.01); *F21Y 2113/13* (2016.08); *F21Y 2115/10* (2016.08)

(58) Field of Classification Search
CPC ..... A41D 27/085; A41G 7/00; A41G 5/0093
USPC ..... 362/103
See application file for complete search history.

(56) References Cited

U.S. PATENT DOCUMENTS

| | | | |
|---|---|---|---|
| D52,781 | S | 12/1918 | Budweiser |
| 1,545,706 | A | 7/1925 | Steingold |
| 1,686,258 | A | 10/1928 | Schlesinger |
| D173,067 | S | 9/1954 | Hagemeyer et al. |
| 2,699,621 | A | 1/1955 | Levinson |
| 2,790,175 | A | 4/1957 | Sowle |
| 2,908,911 | A | 10/1959 | Sowle |
| 3,046,560 | A | 7/1962 | Grazia |
| 3,132,345 | A | 5/1964 | Keith |
| 3,196,458 | A | 7/1965 | Keith |

(Continued)

FOREIGN PATENT DOCUMENTS

WO WO-2007011195 A2 * 1/2007 ..... A41G 5/00

OTHER PUBLICATIONS

Zagone Studios, Men's Supersoft Super Santa, Dec. 4, 2014, per verified review, Amazon.*

(Continued)

*Primary Examiner* — Matthew J. Peerce
(74) *Attorney, Agent, or Firm* — Galgano IP Law PLLC; Thomas M. Galgano

(57) ABSTRACT

A light-up facial covering which simulates the appearance of a beard including a facial covering member which simulates the appearance of a beard and is configured and dimensioned to overlie at least a portion of a lower half of a face of a wearer. The facial covering also including a member for securing the facial covering to the wearer's head and a plurality of electrically powered lights affixed to the facial covering.

17 Claims, 6 Drawing Sheets

(56) References Cited

U.S. PATENT DOCUMENTS

| | | | |
|---|---|---|---|
| 3,340,542 | A | 9/1967 | Greenwald |
| 3,450,872 | A | 6/1969 | Aiello, Jr. |
| 3,501,628 | A | 3/1970 | Madden |
| 3,675,005 | A | 7/1972 | Curiel |
| 3,723,723 | A | 3/1973 | Lerner |
| 3,740,767 | A | 6/1973 | Schuessler |
| 3,758,771 | A | 9/1973 | Frohardt et al. |
| D243,127 | S | 1/1977 | Farquharson |
| 4,300,240 | A | 11/1981 | Edwards |
| 4,317,239 | A | 3/1982 | Bryksa |
| 4,593,417 | A | 6/1986 | Brown, Jr. et al. |
| D286,222 | S | 10/1986 | Talbot |
| D293,932 | S | 1/1988 | Ramseyer |
| 4,781,647 | A | 11/1988 | Doane, Jr. |
| 4,787,372 | A | 11/1988 | Ramseyer |
| D304,869 | S | 11/1989 | Mattox |
| D311,261 | S | 10/1990 | Avey |
| 5,025,507 | A | 6/1991 | Kirby |
| D331,297 | S | 11/1992 | Herod |
| D331,300 | S | 11/1992 | Fountain |
| D363,571 | S | 10/1995 | Klose |
| D366,347 | S | 1/1996 | Avey |
| D367,549 | S | 2/1996 | Deziel |
| D369,442 | S | 4/1996 | Jones |
| 5,534,315 | A | 7/1996 | Witte |
| 5,551,087 | A | 9/1996 | Blutstein et al. |
| D380,871 | S | 7/1997 | Guyette, Jr. |
| 5,765,230 | A | 6/1998 | Sivret et al. |
| 5,782,698 | A | 7/1998 | Keller |
| D397,957 | S | 9/1998 | Lee |
| D406,399 | S | 3/1999 | Hohdorf |
| D423,712 | S | 4/2000 | Aoki et al. |
| D423,726 | S | 4/2000 | Backus |
| D430,361 | S | 9/2000 | Smith |
| 6,126,298 | A | 10/2000 | Wu |
| D434,879 | S | 12/2000 | Cole |
| D444,269 | S | 6/2001 | Jeffreys |
| D452,745 | S | 1/2002 | Chang |
| D453,708 | S | 2/2002 | Roy, Jr. |
| D455,236 | S | 4/2002 | Gatton |
| D462,465 | S | 9/2002 | Tsai |
| D463,513 | S | 9/2002 | Ahquin |
| D483,173 | S | 12/2003 | Harris et al. |
| 6,671,886 | B1 | 1/2004 | Reitz |
| D495,449 | S | 8/2004 | Kellmann |
| D499,206 | S | 11/2004 | Chen |
| D536,836 | S | 2/2007 | Crossman |
| D539,484 | S | 3/2007 | Hillman |
| 7,300,193 | B2 | 11/2007 | Xie |
| D592,832 | S | 5/2009 | Radell |
| D604,910 | S | 11/2009 | Smaller |
| D636,128 | S | 4/2011 | Hancock |
| D638,170 | S | 5/2011 | Chen |
| D657,917 | S | 4/2012 | Chen |
| D670,038 | S | 10/2012 | Andrews et al. |
| 8,347,419 | B1 | 1/2013 | Cleva |
| D692,186 | S | 11/2013 | Phillips |
| 8,621,668 | B1 | 1/2014 | Nolz |
| D699,020 | S | 2/2014 | Caird |
| 8,783,253 | B2 | 7/2014 | Flaherty |
| D722,744 | S | 2/2015 | Brown |
| D725,827 | S | 3/2015 | Boley-Morse |
| 9,200,797 | B1 | 12/2015 | McNulty |
| 2004/0078869 | A1* | 4/2004 | Bell ..... A41D 13/1161 2/206 |
| 2005/0068762 | A1* | 3/2005 | Post ..... A41D 27/085 362/105 |
| 2006/0044784 | A1 | 3/2006 | Lee |
| 2009/0064390 | A1 | 3/2009 | Beiring et al. |
| 2013/0055486 | A1 | 3/2013 | Hasbany et al. |
| 2014/0141180 | A1 | 5/2014 | Jaffee |
| 2014/0304887 | A1 | 10/2014 | Ilges |
| 2014/0304891 | A1* | 10/2014 | Waters ..... A42B 1/24 2/209.13 |

OTHER PUBLICATIONS

Forum Novelties, Forum Men's Light up Santa Beard, Mar. 21, 2016, Amazon.*

David Yi, 9 wild ways to bling your beard for holiday parties, Dec. 17, 2015, Mashable, #4 May your days be merry and bright.*

* cited by examiner

LIGHT-UP BEARD

CROSS-REFERENCE TO RELATED APPLICATION

This application claims benefit from U.S. Provisional Patent Application No. 62/323,862, filed Apr. 18, 2016, the contents of which are hereby incorporated by reference.

BACKGROUND OF THE INVENTION

1. Field of the Invention

The invention is generally in the field of wearable accessories. More particularly, the present invention is directed to a novelty facial covering in the shape and configuration of a beard, having a plurality of lights incorporated therein.

2. Brief Description of the Prior Art

For certain occasions or events, such as holidays, celebrations, or at various sporting events, it is desirable to have themed accessories which show one's support or connection to the particular event or occasion. A number of accessories are known and utilized for various events and occasions such as clothing, headwear, sunglasses, costumes, etc. However, it is desirable to provide novel accessories and, in particular, a novel facial covering in the configuration of a beard. Furthermore, it is desirable to incorporate lights into the beard to increase interest in the accessory and enhance its appearance.

SUMMARY OF THE INVENTION

It is therefore an object of the present invention to provide a novel accessory and particularly, a novelty facial covering that simulates the appearance of a beard.

It is also an object of the present invention to provide a novelty beard which has a plurality of lights incorporated therein to enhance the appearance of the beard.

It is a further object of the present invention to provide a novelty beard having ornamentation affixed thereto.

Certain of the foregoing and related objects are readily attained according to the present invention through the provision of a light-up facial covering which simulates the appearance of a beard, comprising a facial covering member that is configured and dimensioned to overlie at least a portion of a lower half of a face of a wearer, said facial covering being configured and dimensioned to simulate the appearance of a beard; means for securing said facial covering member to a wearer's head; a plurality of electrically powered lights affixed to said facial covering member; and means for electrically powering said plurality of lights connected to said facial covering member.

Preferably, said means for securing said facial covering member to a wearer's head comprises a pair of lateral flaps connected to said facial covering member, wherein said facial covering member and said lateral flaps encircle the wearer's head and said flaps are removably connectable, to secure said facial covering member to the wearer's head. Desirably, said facial covering member has opposite lateral side edges and said lateral flaps extend outwardly from said lateral side edges of said facial covering member. In the preferred embodiment, said facial covering member and said lateral flaps are one-piece.

It is also preferable that said lateral flaps comprise mating hook and loop fasteners for securing said facial covering member to the wearer's head. Advantageously, said hook and loop fasteners are adjustable, to permit the user to adjust the size of said facial covering. Desirably, said facial covering member comprises a mouth opening. Advantageously, said facial covering member comprises an outer layer having an inner surface and an outer surface and an inner layer having an inner surface and an outer surface.

It is preferred that said lights further comprise a plurality of wires connecting said plurality of lights to said means for electrically powering said plurality of lights, and wherein said lights are affixed to said outer surface of said outer layer and said plurality of wires are connected to said inner surface of said outer layer. Desirably, said inner layer overlies said plurality of wires and said inner surface of said outer layer.

Advantageously, the facial covering further comprises a plurality of hairs affixed to said outer surface of said outer layer to simulate the appearance of a beard. Preferably, the facial covering further comprises ornamentation affixed to said outer surface of said outer layer of said facial covering member. It is also preferred that said ornamentation is three-dimensional. Desirably, said plurality lights are LEDs. It is also advantageous that the facial covering further comprises a pocket formed in said inner layer for holding said means for electrically powering said plurality of lights. Preferably, said plurality of lights are intermittent. Desirably, said plurality of LED lights are colored.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
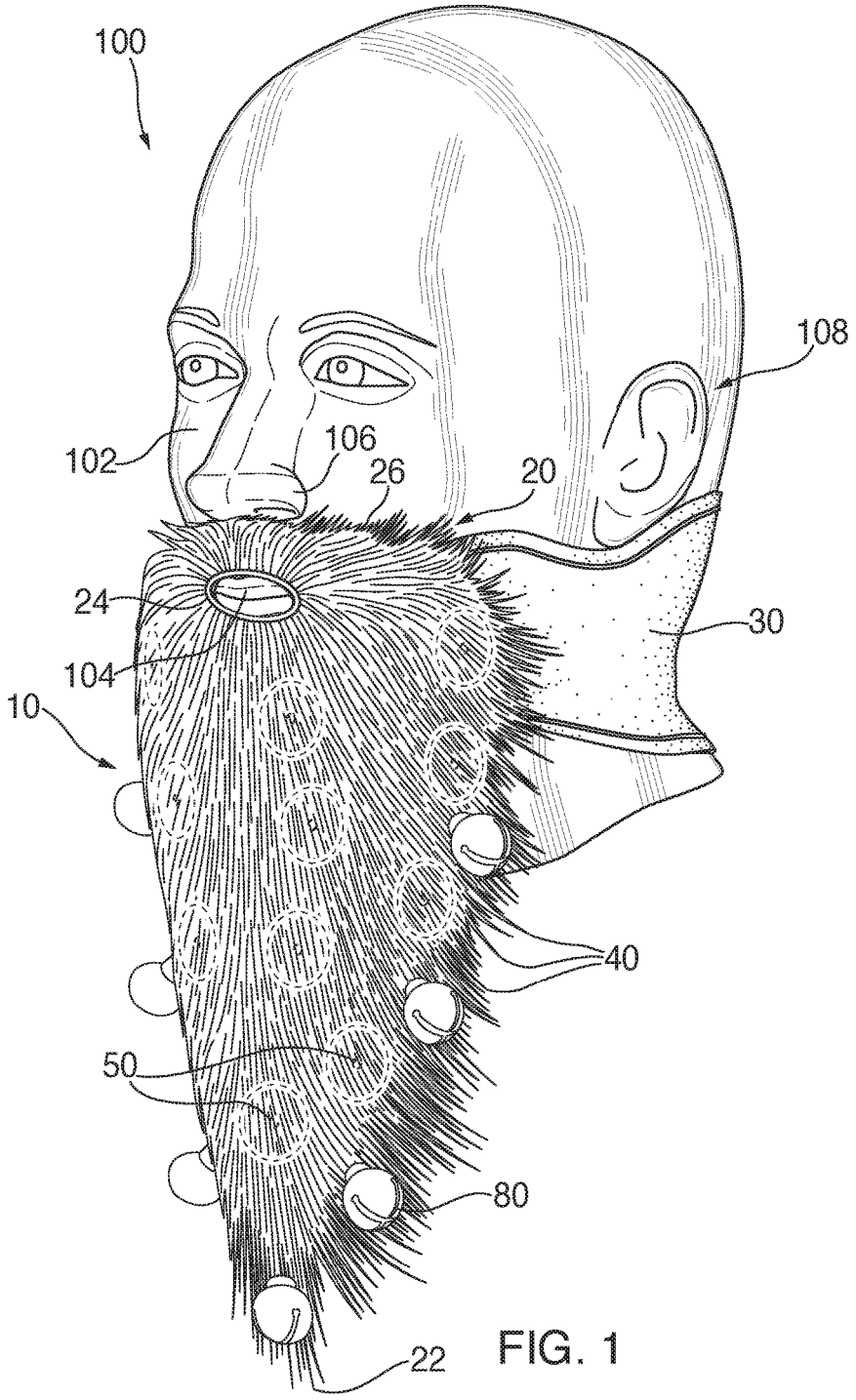
FIG. 1 is a front and side perspective view of the light-up beard, according to the present invention, being worn over a wearer's face and secured around a wearer's head.

Turning now in detail to the drawings and FIG. 1, in particular, which illustrates the light-up facial covering or beard 10, according to the present invention, which simulates the appearance of a beard. Beard 10 is illustrated overlying a portion of a face 102 of a wearer 100 and is secured around the head 108 of the wearer 100. Beard 10 is a novelty beard which is configured and dimensioned to be removably worn generally over the lower half of a wearer's face 102, to simulate the appearance of a natural beard. Beard 10 can assume any desirable beard shape and configuration and the arrangement is not limited to the specific shape of the embodiments illustrated and described herein.

Figure 3:
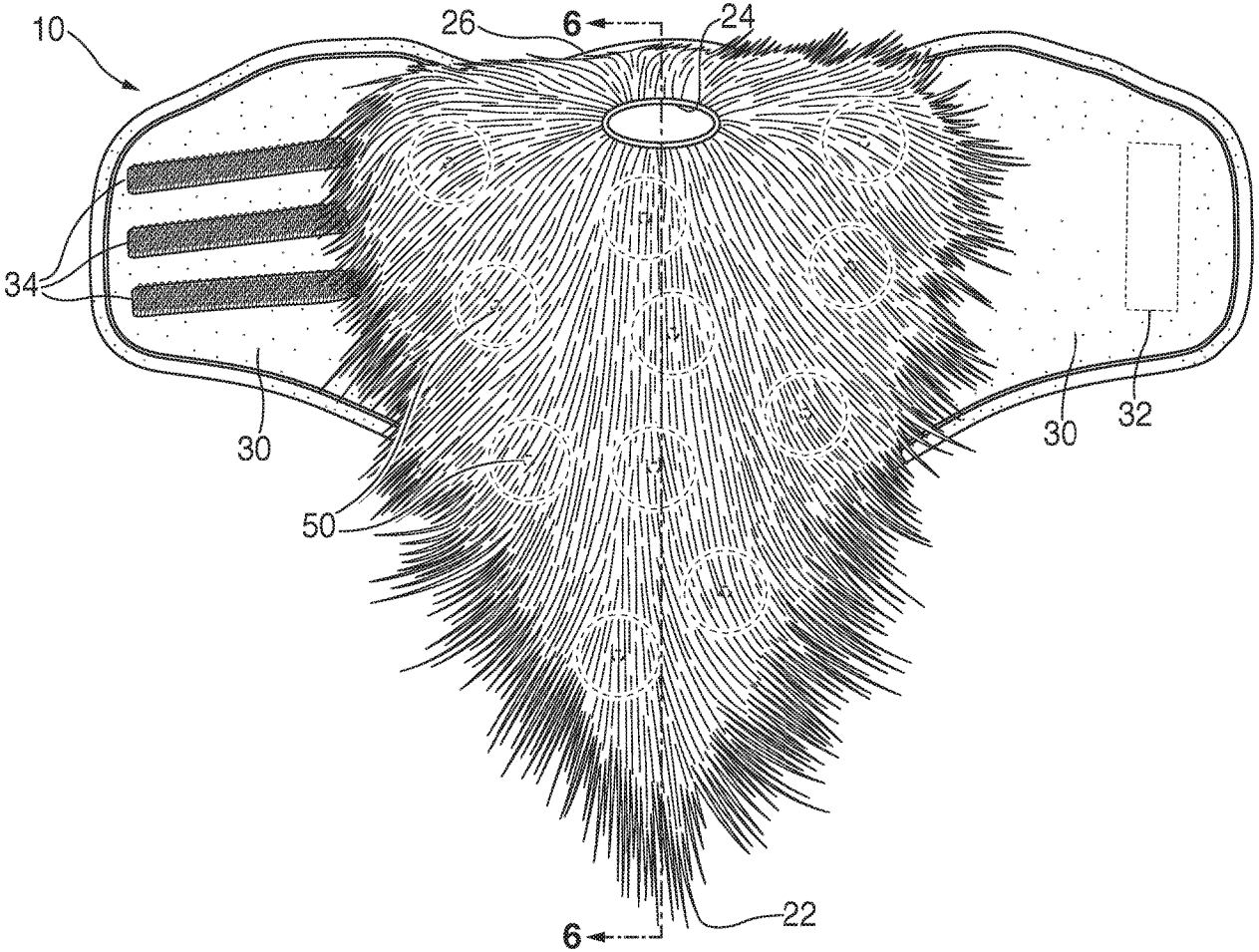
FIG. 3 is a front elevation view of the light-up beard, with the lateral flaps extended outwardly to the sides.

As shown in FIGS. 1 and 3, beard 10 includes a front facial covering member 20 which is configured and dimensioned to simulate the appearance of a beard and overlies at least a portion of a lower half of a face 102 of a wearer 100, in a manner and placement that a beard would normally appear. As seen best in FIG. 1, front facial covering member 20 assumes the shape, configuration, and appearance of a beard. In the embodiment illustrated herein, front facial covering member 20 is a "Santa-Claus-style" beard having a longitudinally extending beard which tapers to a point on its lower end 22. However, it can be appreciated that facial covering member 20 may assume the shape and configuration of other types of beards.

As seen in FIGS. 1 and 3, facial covering member 20 includes a mouth opening 24 defined therein and has an upper edge 26. In use, as shown in FIG. 1, mouth opening 24 of facial covering member 20 is positionable over and around the mouth 104 of the wearer 100 with the upper edge 26 of facial covering member 20 disposed generally beneath and adjacent to the nose 106 of the wearer 100, to give the appearance of a natural beard.

Figure 2:
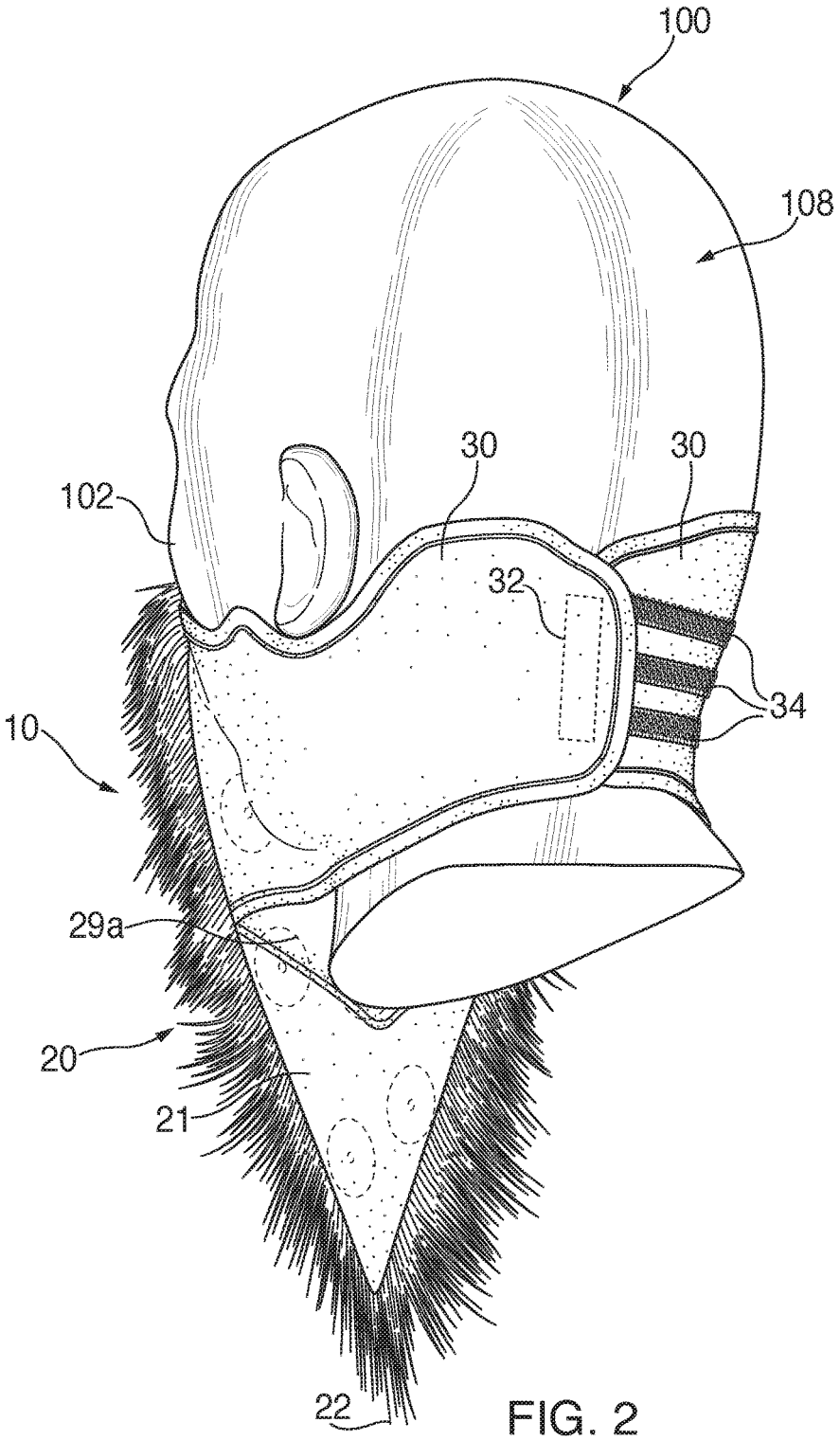
FIG. 2 is a rear and side perspective view of the light-up beard, according to the present invention, secured around the wearer's head.

Beard 10 also includes means for securing facial covering member 20 to a wearer's head 108. In the preferred embodiment, the means for securing facial covering member 20 to the wearer's head 108 is via a pair of lateral flaps 30 connected to facial covering member 20. As seen in FIGS. 1-2, facial covering member 20 and lateral flaps 30 collectively encircle the head 108 of the wearer 100, to secure beard 10 in place. Particularly, as seen in FIG. 2, flaps 30 are removably connectable in the rear of the head 108 of the wearer 100, to secure facial covering member 20 over the face 102 of the wearer 100. To remove beard 10 from the head 108 of the wearer 100, the flaps 30 are manually disconnected and beard 10 can be removed. More particularly, as seen best in FIG. 4, facial covering member 20 has opposite lateral side edges 28 and a lateral flap 30 is connected to and extends outwardly from each of lateral side edges 28 of facial covering member 20. Preferably, facial covering member 20 and lateral flaps 30 are an integral one-piece component.

In use when worn as illustrated in FIGS. 1-2, flaps 30 extend outwardly from face covering member 20, and wrap around the sides of the wearer's head 108 and, as shown best in FIG. 2, overlap in the rear of the wearer's head 108, to removably hold beard 10 in place around a wearer's face 102 and head 108. While beard 10 is removably secured around a wearer's head using flaps 30, other means for removably securing beard 10 can be utilized, such as, for example, an elastic band or strap extending around the sides and rear of the wearer's head 108.

Figure 4:
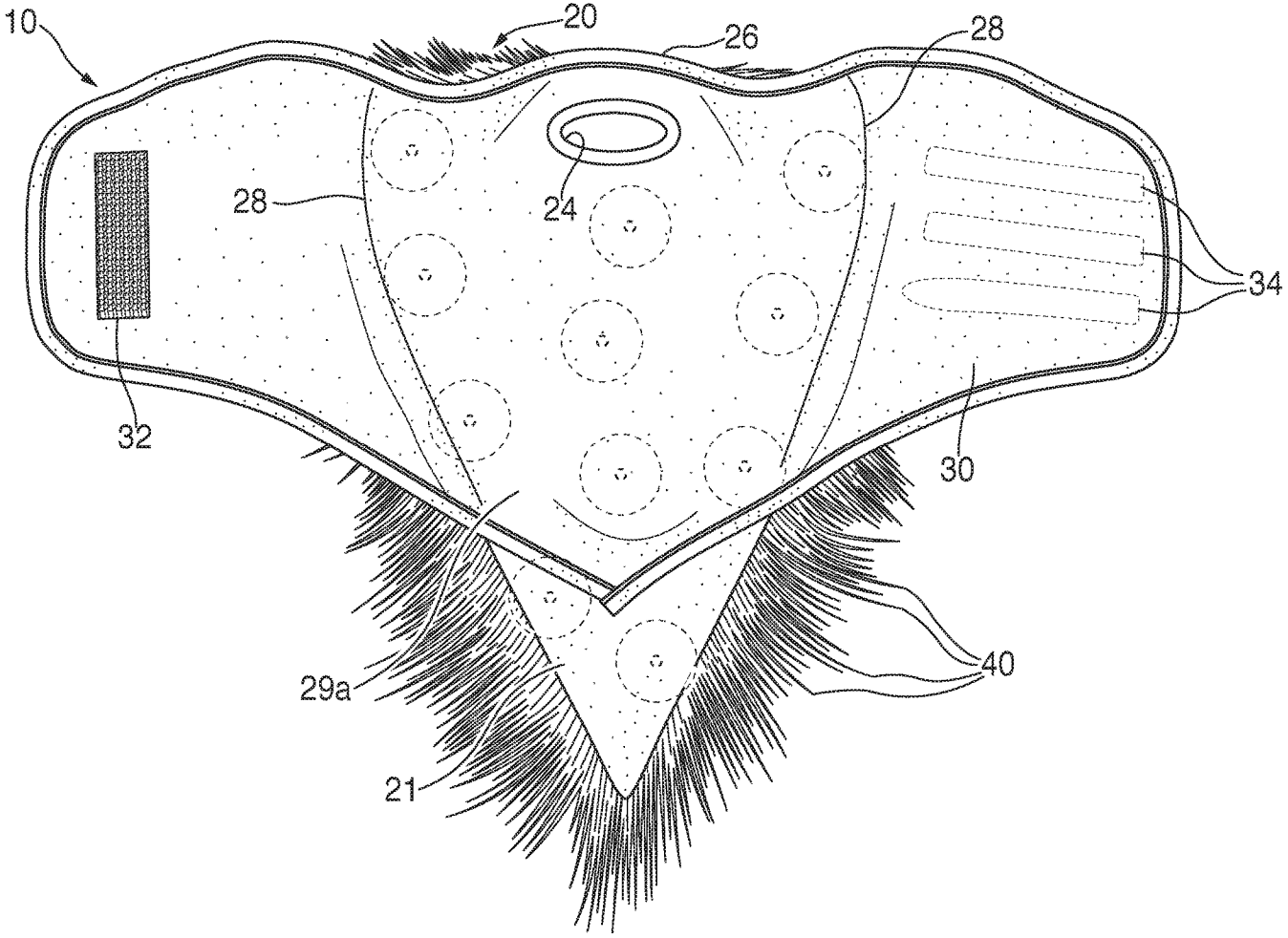
FIG. 4 is a rear elevation view of the beard in FIG. 3.

As seen in FIGS. 2-4, flaps 30 include a corresponding mating hook fastener 32 and loop fastener 34, to allow the flaps 30 in beard 10 to be removably secured in the rear of a wearer's head 108. As seen best in FIG. 2, hook and loop fasteners 32 and 34, respectively, are adjustable and can be affixed together at varying locations to accommodate wearer's having different sized heads. As seen in FIG. 2, loop fasteners 34 extend generally horizontally on flap 30 and hook fastener 32 extends generally vertically on the other flap 30. Hook fastener 32 mates with loop fasteners 34 anywhere along their length to change the size of beard 10. It can be appreciated that the placement and number of hook and loop fasteners can vary. Although hook and loop fasteners 32 and 34, respectively, have been described and illustrated herein, the means for removably fastening the flaps 30 on beard 10 are not limited thereto and other suitable fastening means can be utilized such as, for example, snaps, button closures, zippers, adhesives, or elastic means. Such means for removably fastening beard 10 around a wearer's head 108 would be well known to those having ordinary skill in the art.

Figure 5:
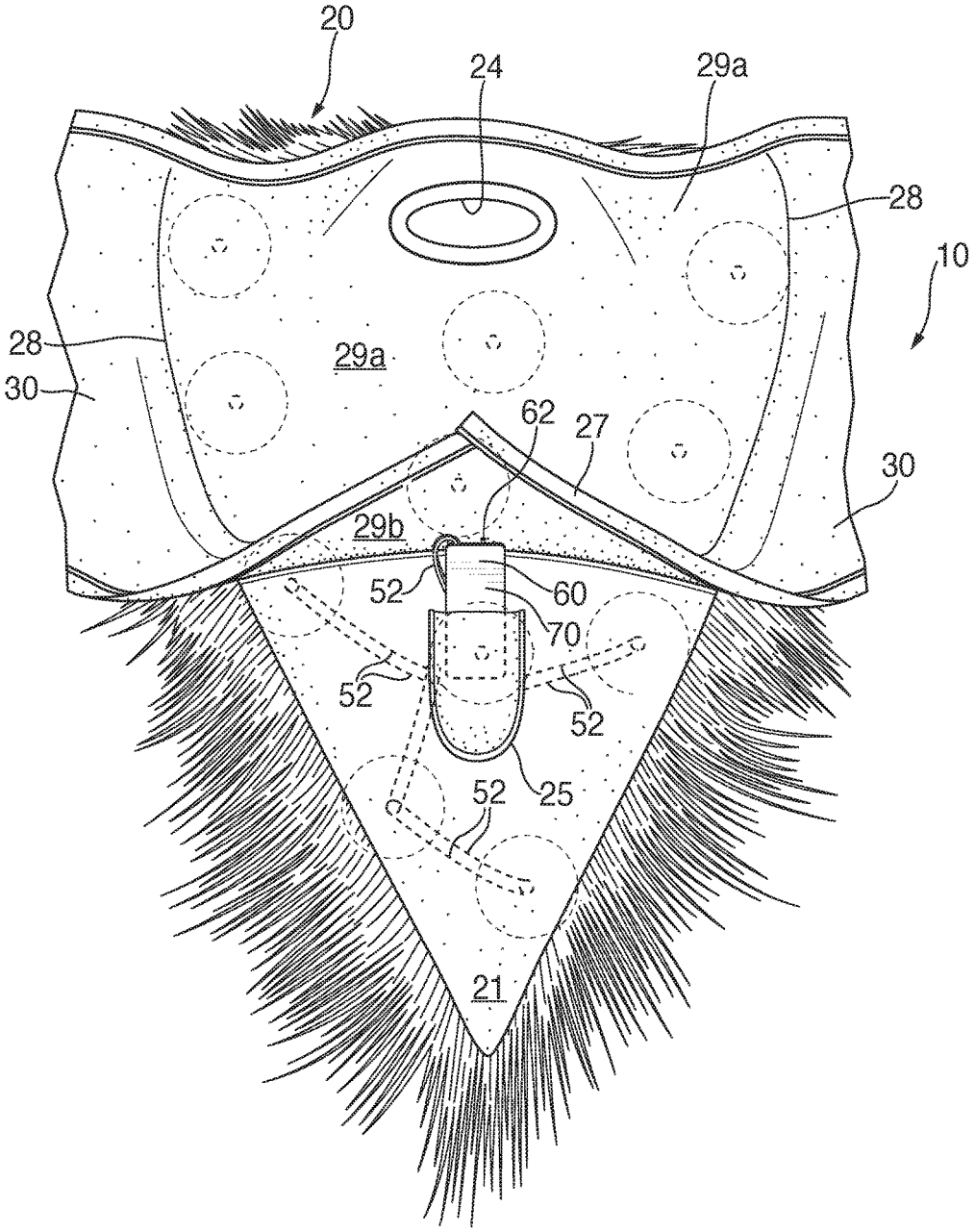
FIG. 5 is a rear elevation view of the facial covering member and a portion of the lateral flaps, showing a lower portion of the upper inner layer folded upwardly to expose the pocket formed on the inner side of the lower inner layer.
Figure 6:
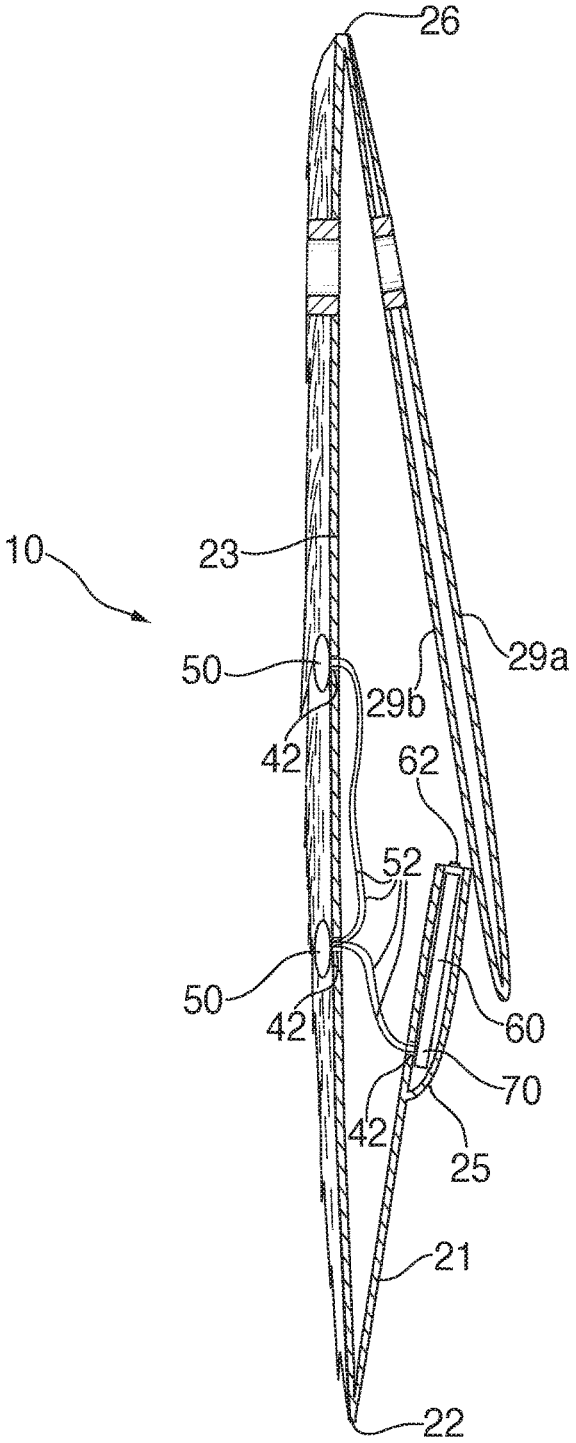
FIG. 6 is a cross-sectional view along line 6-6 in FIG. 3.

As seen best in FIGS. 5-6, facial covering member 20 includes upper inner layers 29*a* and 29*b* and a lower inner layer 21. Upper inner layer 29*a* and lower inner layer 21 overlie the wearer's face 102. Facial covering member 20 also includes an outer exposed layer 23 which is outwardly visible. Alternatively, facial covering member 20 may have only a single inner layer and an outer layer. Inner and outer layers 21, 29*a*, 29*b*, and 23, respectively, as well as flaps 30 may be composed of multiple plies of fabric. The fabric may be a fleece material. However, flaps 30 and facial covering member 20 may be constructed in any suitable manner and with any suitable fabric. In the preferred embodiment, flaps 30 are two-ply and upper inner layers 29*a* and 29*b* and flaps 30 are integral. More particularly, upper inner layer 29*a* and one ply of flaps 30 is formed of one piece of fabric and layer 29*b* and the other ply of flaps 30 are another piece of fabric. These layers of fabric are sewn together with outer layer 23 and lower inner layer 21.

As seen best in FIGS. 1 and 3, outer layer 23 is covered with faux hairs 40 to simulate the appearance of hair from a natural beard. The means for securing hairs 40 to outer layer 23 would be well known to a person having ordinary skill in the art. However, it can also be appreciated that faux hair 40 is not required and other materials or fabrics may be utilized to give the appearance of a beard, such as, for example, yarn or other fabric. Faux hair 40 can be any color as desired or multiple colors in any desired pattern.

As also seen in FIGS. 1-5, beard 10 incorporates a plurality of electrically powered lights 50 affixed to facial covering member 20 and visible on outer layer 23. Particularly, beard 10 includes a plurality of spaced-apart lights 50 scattered throughout face covering portion 20 of beard 10. The exact placement and arrangement of lights 50 on beard 10 can vary and may assume any desired placements within beard 10. Lights 50 may be of any variety of colors and may even change color. Lights 50 may be LED lights however, other suitable lighting means may be utilized such as fiber optic lights. Furthermore, lights 50 may blink, strobe, or have other intermittent or flashing patterns which are controlled by a processor or other control means 70, as desired.

Lights 50 are connected to each other as well as means for electrically powering the plurality of lights 50, such as a power source 60 by a plurality of wires 52. Power source 60 may be a battery pack, however, other suitable means to power lights 50 may be utilized and would be well known to those having ordinary skill in the art. Furthermore, the plurality of wires 52 connect lights 50 to control means 70 for controlling the color and/or flashing pattern of lights 50.

In a preferred embodiment, as seen best in FIGS. 1 and 5-6, a plurality of openings 42 are formed in outer layer 23 and a light 50 extends through each of openings 42 in outer layer 23 and is visible on facial covering member 20. Preferably, the wires 52 connected to lights 50 are concealed within beard 10 and are not visible from the exterior or interior sides of the beard. Particularly, in the embodiment illustrated in FIGS. 5-6, wires 52 are secured to the interior side of outer exposed layer 23 and are covered by layers 29*a*, 29*b*, and 21. Furthermore, as illustrated in FIG. 5, a pocket 25 may be formed on lower inner layer 21 for holding power source 60 and/or control means 70. As also seen in FIGS. 5-6, a lower portion 27 of upper inner layers 29*a* and 29*b* overlies a portion of lower inner layer 21 to conceal pocket 25. As seen in FIG. 6, opening 42 is formed in lower inner layer 21 to permit wires 52 to extend through lower inner layer 21 and connect to power source 60 and/or control means 70. Control means 70 and power source 60 can be a single unit or separate units and turned on and off by a switch 62. However, it can be appreciated that the means for powering and controlling lights 50 may vary and the exact placement of wires 52, power source 60, and control means 70 may vary and can assume other configurations.

Beard 10 may form different beard styles such as a "Sata-Claus-style" beard as seen in FIGS. 1-5 or may be a beard resembling that of a leprechaun, a particular character, or in the theme of a particular sports team. Any other suitable configurations and appearances are possible for beard 10 and contemplated by the present invention. Additionally, beard 10 can be any color or variety of colors. Furthermore, lights 50 and beard 10 may form an overall theme such as for a particular occasion or holiday, like Christmas or St. Patrick's Day, or be in the colors or theme of a particular character or sports team. Beard 10 may also include other two or three-dimensional ornamentation affixed to the exterior side of face covering portion 20, such as bells 80 as seen in FIG. 1, or holly and berries. However, the nature of the ornamentation may vary as well as its placement on beard 10.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made to the present invention without departing from the spirit and scope of the invention. Particularly, certain embodiments of the present invention have been illustrated and described, but it can be appreciated that the appearance and configuration of beard 10 incorporating lights 50 can vary. Furthermore, the location and placement of the elements described herein may also vary, so long as beard 10 incorporates lights 50.

What is claimed is:

1. A light-up facial covering which simulates the appearance of a beard, comprising:

a facial covering member that is configured and dimensioned to overlie at least a portion of a lower half of a face of a wearer, said facial covering member comprising an outer layer having an interior side and an exterior side, said exterior side having faux hairs attached thereto dimensioned to simulate the appearance of a beard, and a plurality of spaced-apart openings extending from said interior side to said exterior side;

means for securing said facial covering member to a wearer's head comprising a pair of lateral flaps connected to said facial covering member, a plurality of electrically powered lights, each of said electrically powered lights being affixed to said facial covering member extending from said interior side through one of said openings to said exterior side so that it is visible, when lit, through said faux hairs on said outer layer of said facial covering member; and means for electrically powering said plurality of lights affixed to said facial covering member.

2. The facial covering according to claim 1, wherein:

said facial covering member and said lateral flaps together encircle the wearer's head and said flaps are removably connectable, to secure said facial covering member to the wearer's head.

3. The facial covering according to claim 2, wherein:

said lateral flaps comprise mating hook and loop fasteners for securing said facial covering member to the wearer's head.

4. The facial covering according to claim 3, wherein:

said hook and loop fasteners are adjustable, to permit the user to adjust the size of said facial covering.

5. The facial covering according to claim 1, wherein:

said facial covering member has opposite lateral side edges and said lateral flaps extend outwardly from said lateral side edges of said facial covering member.

6. The facial covering according to claim 5, wherein:

said facial covering member and said lateral flaps are one-piece.

7. The facial covering according to claim 1, wherein:

said facial covering member comprises a mouth opening extending from said interior side to said exterior thereof.

8. The facial covering according to claim 1, wherein:

said plurality of lights further comprise a plurality of wires connecting said plurality of lights to said means for electrically powering said plurality of lights, and wherein said plurality of wires are connected to said interior side of said outer layer.

9. The facial covering according to claim 8, wherein:

said facial covering member further comprises at least one inner layer coupled to said outer layer, said inner layer having an inner surface covering said plurality of wires connected to said interior side of said outer layer and an outer surface which is disposed so that it will be at least partially disposed adjacent the wearer's face, when worn.

10. The facial covering according to claim 9, wherein:

said inner surface of said inner layer overlies said plurality of wires and said interior side of said outer layer.

11. The facial covering according to claim 9, further comprising:

a pocket formed on said inner layer for holding said means for electrically powering said plurality of electrically powered lights.

12. The facial covering according to claim 1, further comprising:

ornamentation affixed to said exterior side of said outer layer of said facial covering member.

13. The facial covering according to claim 12, wherein:

said ornamentation is three-dimensional.

14. The facial covering according to claim 1, wherein:

said plurality of electrically powered lights are LEDs.

15. The facial covering according to claim 1, wherein:

said electrically powered lights are powered intermittently.

16. The facial covering according to claim 1, wherein:

said plurality of electrically powered lights are colored.

17. A light-up facial covering which simulates the appearance of a beard, comprising:

a facial covering member that is configured and dimensioned to overlie at least a portion of a lower half of a face of a wearer, said facial covering member comprising an outer layer having an interior side and an exterior side, said exterior side having faux hairs attached thereto dimensioned to simulate the appearance of a beard, and a plurality of spaced-apart openings extending from said interior side to said exterior side;

means for removable securing said facial covering member to a wearer's head comprising a pair of lateral flaps connected to said facial covering member;

a plurality of electrically powered lights, each of said electrically powered lights being affixed to said facial covering member extending from said interior side through one of said openings to said exterior side so that it is visible, when lit, through said faux hairs on said outer layer of said facial covering member;

means for electrically powering said plurality of lights affixed to said facial covering member; and a plurality of wires connecting said plurality of lights to said means for electrically powering said plurality of lights which are connected to said interior side of said outer layer and are covered by said inner surface of said inner layer.

* * * * *